United States Patent [19]

Tryba

[11] Patent Number: 4,726,149

[45] Date of Patent: Feb. 23, 1988

[54] FIXTURE FOR PROTECTION OF WINDOWS

[76] Inventor: Anthony Tryba, 479 Crawford St., Biloxi, Miss. 39530

[21] Appl. No.: 937,692

[22] Filed: Dec. 4, 1986

[51] Int. Cl.[4] ..... E05C 21/02

[52] U.S. Cl. ..... 49/465; 49/61

[58] Field of Search ..... 49/61, 62, 465, 463; 52/202, 203

[56] References Cited

U.S. PATENT DOCUMENTS

| | | | |
|---|---|---|---|
| 1,192,325 | 7/1916 | Kurth | 49/465 X |
| 1,258,826 | 3/1918 | Thompson | 49/61 X |
| 2,629,143 | 2/1953 | Spector et al. | 49/62 X |
| 2,923,351 | 2/1960 | Zitomer | 49/61 X |
| 4,060,936 | 12/1977 | Jensen et al. | 49/465 |
| 4,364,198 | 12/1982 | Netti | 49/62 |

*Primary Examiner*—Philip C. Kannan

*Attorney, Agent, or Firm*—Alexander F. Norcross

[57] ABSTRACT

An installable window protector, for protecting windows against flying debris incident to severe storms is provided for metal extrusion frame windows. A rectangular sheet of plywood, sized to the internal dimensions of the window frame, is provided with two, vertically in line handles in the lower third section to permit the entire sheet to be readily twisted and manipulated by an individual standing within the window. The end of the sheet opposite to the location of the handles is provided with a tapered edge and at a location approximately at a lower third dividing line of the sheet two opposed extendable deadbolts are installed. The sheet is easily installed to cover the exterior of the window by a person standing in the house, by opening the window and manipulating the sheet by means of holding both handles so as to pass the sheet to the outside of the window. The sheet then may be readily engaged with the top lip of the metal window frame, the taper serving to guide the sheet into place. The sheet is then pulled snug against the window frame and secured by means of extending the left and right deadbolts. Cooperating holes may be provided within the metal frame to further engage the deadbolts.

The sheet provides a tight fitting cover, resistant to tampering from the outside, and providing suitable flying debris and other impact protection for the windows.

1 Claim, 6 Drawing Figures

FIXTURE FOR PROTECTION OF WINDOWS

BACKGROUND OF THE INVENTION

This invention relates to an apparatus for protecting windows from damage due to inclement weather, storms, and the like.

Severe storms, such as hurricanes, require special protection for glass windows in houses and buildings to prevent damage due to the effects of the storm. The principal source of such damage is from windblown debris, and such debris generally is considered to account for a higher incidence of damage to windows than is caused by wind over pressure and subsequent breakage. Protection of windows is particularly important in the case of houses, due to the vulnerability of house contents to damage from water and debris. A significant and common cause of storm damage to the interior to homes, water damage, is often a consequence of the failure of one or more windows, which then permits driven rain and heavy water to enter during the course of a major storm.

It has, therefore, become customary to board up windows with various forms of protective sheeting so as to protect the glass panes in the window from impact by blowing debris. Even minor debris, such as small tree limbs, pieces of wood and the like, can become dangerous particles to a glass window at the wind speeds commonly encountered in a major storm.

A principal problem not readily solved by current art window protective devices is the problem of installation of these devices on windows that are not on a ground floor and installation on windows which are of metal frame construction.

The classic solution, to nail a piece of plywood across the window opening, is not feasible where the exterior of the building is stone, brick or metal, and it is extremely difficult where the window frame is made out of metal extrusion. Since metal extrusion window frames are now the most common form of window frames found in the United States, they pose a significant problem in regards to boarding up windows temporarily for storm protection.

In addition, a homeowner faces significant problems in successfully reaching and securing windows on the second floor and above in a home or apartment. The time available for securing a home and evacuating is often quite short. The movement and installation of an exterior shutter or barrier is often beyond the physical capability of a single homeowner, especially in the inclement weather that precedes a major storm. The attempt to manipulate and install a sheet of plywood or similar screen large enough to cover a typical window opening may be extremely unsafe for a single individual trying to work from an extension or step ladder, and the problem is worse where that individual has limited carpentry skills and is not used to such exertion.

In addition, while prior art window protections address the problem of affixing an exterior protective device to a window opening where it is not feasible or desireable to drive nails, none of the prior art devices address the difficulty encountered by a single individual who must install the devices on very short notice, often in inclement weather, and at elevations to high to reach from the ground. These problems are, of course, only exacerbated where the homeowner or resident is elderly or handicapped.

SUMMARY OF THE INVENTION

It is the purpose of this invention to disclose an apparatus particularly adapted for being installed by a single individual to protect a window of the modern metal frame type, where the apparatus is adapted to being installed from inside the window, without requiring the use of a step ladder or access to the exterior of the building. The device is particularly suitable for manipulation by a single individual who must rapidly respond and secure window surfaces from flying debris, and has the additional advantage in its preferred embodiment that it presents a recessed tight fit protection over the window which is visibly resistant to removal by looters and thieves.

The device comprises a lightweight sheet of protective material, adapted primarily to resist and lessen the impact of driven particles and debris and shaped so as to exactly fit within the provided space of standard form windows. It is the discovery of the inventor that, in the form in which metal frame windows are manufactured and sold, in a few common, standardized sizes, it is practical to provide an equally small number of standardized protective covers, each adapted to a particular size metal frame window.

It is found that essentially all metal frame windows commonly sold in the United States contain a screen adaptor, which at a minimum, comprises an upper and a lower u-shaped channel adapted for receiving an outer screen.

The invention, here disclosed, is a single sheet, adapted to withstanding driven materials and equipped with two spaced manipulation handlholds in its lower third which permit a single individual to lift and manipulate the sheet by two-handed operation of the handholds. The sheet is sized so as to fit within the provided upper and lower channels of the metal frame window, and to securely cover, side to side, the entire window area. Optionally, an entry aiding bevel is provided at the upper end of the sheet to ease the manipulations of the sheet, by the installer, in engaging the sheet fittingly within the upper screen retention channel. A pair of side engaging latches is activated, once the sheet has been placed within the upper and lower channels, to affix the sheet firmly to within the metal frame of the window, and the protective sheet then provides a smooth, impact resisting protection for the window.

It is thus an object of the invention to provide a protective covering for a window which can be readily installed by a single individual from inside the building within which the window is affixed.

It is a further object of this invention to provide an impact resisting protective covering for a window which provides a uniform recessed installation, resistant to ready removal from the outside.

It is a further object of this invention to provide a uniform series of impact resisting protective covers for windows which are particularly adapted to be mated with and sold with standard form metal frame windows.

This and other objects of the invention may readily be seen from the detailed description of the preferred embodiment which follows.

DETAILED DESCRIPTION OF THE PREFERRED EMBODIMENT

Figure 1:
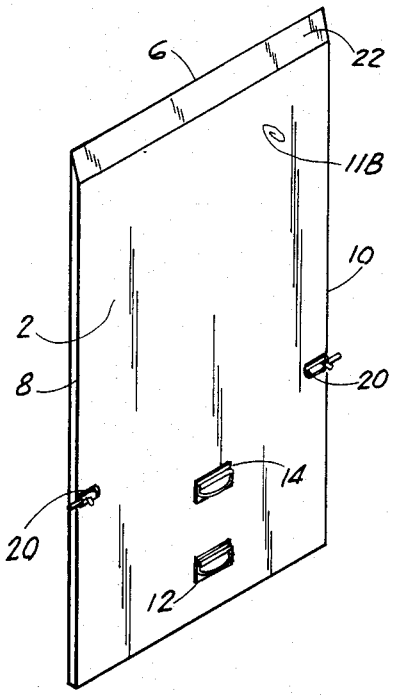
FIG. 1 shows an angled view of the invention.
Figure 2A:
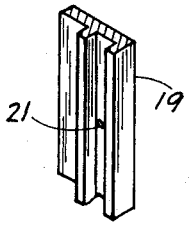
FIG. 2A shows a section of a side channel member of the metal frame window shown in FIG. 2.
Figure 2:
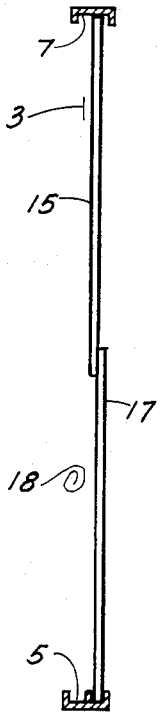
FIG. 2 shows a cross-section side view of a typical metal frame window.

The construction of the invention may most clearly be seen by reference to the drawings, showing in FIG. 1, in angled view the impact protector 1 of the invention. The invention is constructed from an essentially rectangular sheet 2 which is sized to match the outer dimension of a mating metallic window frame 3, shown in FIG. 2. The construction of window frame 3 is well understood in the prior art, and is known to include a bottom channel 5, defining the lower edge of the window, an upper or top channel 7 defining the upper edge of the window and connecting side channels, not shown for clarity, but shown in sectional view as side channel member 19 in FIG. 2A.

The dimensions of window frame 3 define the dimensions and corresponding edges of sheet member 2. Thus bottom edge 4 is adapted in length to the width of bottom channel 5 of the window. Top edge 6 is likewise adapted in width to the width of top channel 7, and first side 8 and second side 10 of the sheet 2 are in length defined by the vertical distance between the top 7 and the bottom 5 of the window 3.

Sheet 2 is in the preferred embodiment made of an impact resisting material which may either be an exterior or treated grade of plywood, which by its laminated construction, is know to have significant impact resistance or, in an alternative embodiment, to be a metal or fiberglass casing over a lightweight core, such construction known to combine impact resistance with lightweight and weather resisting features. However, it should be apparent that as the invention is only to be installed during storms, weather resistance is not material to its use as a protector, but rather is an advantage, permitting storage during periods of nonuse in areas exposed to the elements, rather than requiring more protected storage.

It is a characteristic of commonly available metal frame windows in common use within this country that they are of a restricted range of sizes, and these sizes may readily be determined, as they are in essence common industry standards within the construction trade. For a given window 3 then it is possible to fabricate dimensions of sheet 2 so as to exactly cover window 3. Sheet 2, by definition, will have two faces defined by its orientation with respect to window 3; these are arbitrarily labeled outer face 11*a* and inner face 11*b*. On a lower third of inner face 11*b* and found provided a first lower handhold 12 which may be any convenient handgrip such as a standard furniture handle, a recess adapted for gripping molded into the face, or any other construction easily gripped by human hand. Above lower handhold 12 at a point intermediate the lower handhold and a point representing approximately the middle section of sheet 2 will be found upper handhold 14. For convenience in manipulation it is best that lower handhold 12 and upper handhold 14 be centered between side 8 and side 10 so as to produce a balanced, side to side aspect to sheet 12.

Figure 3A:
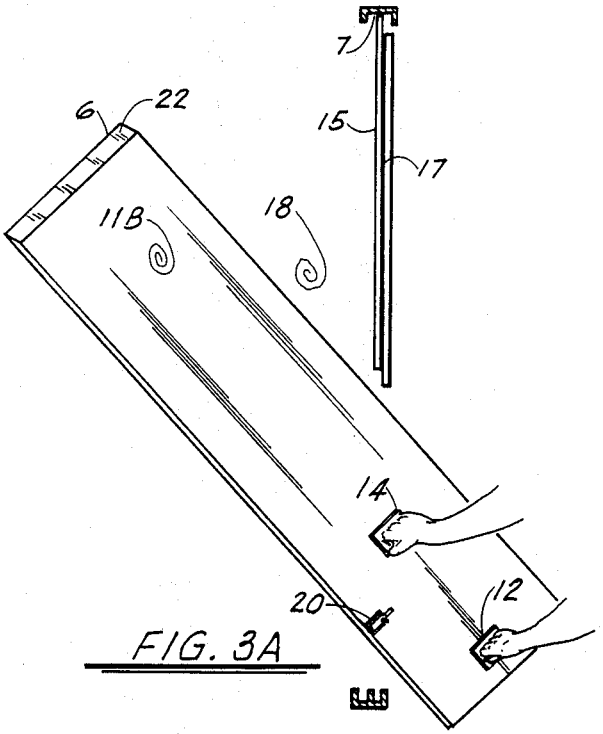
FIG. 3A, 3B, and 3C show three stages in the installation of the current invention within the metal frame window depicted in FIG. 2.
Figure 3B:
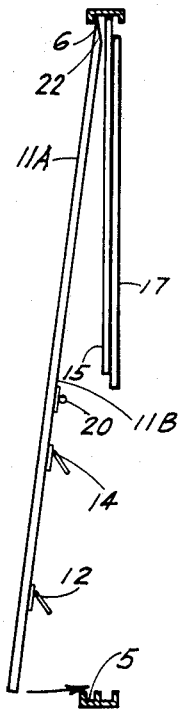
Figure 3C:
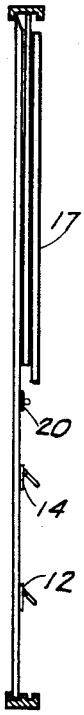

In use, as is shown in FIG. 3A, common windows 3 will be found to have a fixed upper pane portion 15 and a slidably movable lower pane portion 17, which may be raised to admit air. There optionally may be found a partial screen for the exclusion of insects covering the opening made by the raising of lower window section 17; this screen, which is removable, is omitted for clarity.

When it is desirable to provide storm protection to window 3, lower window member 17 is raised to its full height, exposing an opening which is usually found to be greater than one-third of the vertical height of window 3 but less than one-half of the vertical height of window 3, because of the necessity of mechanical overlap between the upper and lower sections of the window. The impact protector 1 is then grasped for manipulation by using two hands, grasping respectively the lower handhold 12 and the upper handhold 14. By the spaced apart nature of the handholds it will be found that the sheet may be picked up and readily maneuvered by applying twisting and lifting forces to the handholds. The sheet 2 is then tilted so as to readily be placed through the opening provided by the raising of lower member 17 and inserted through the opening to exterior 18 of window 3.

The sheet 2 having been manipulated so that it is fully exterior to window 3 is then tilted so as to bring top edge 6 into engaging relationship with top channel 7 of window 3. It is found that providing a tapered bevel or upper edge taper 22 on top edge 6 of the sheet 2 materially eases the task of engaging upper edge 6 contactingly into top channel 7. The sheet is then raised within top channel 7, brought into engaging relationship with bottom channel 5 and lowered thereunto.

Provided on first side 8 and second side 10 of the impact protector 1 are latching means 20, which in the preferred embodiment of the invention are latchable dead bolts. Latching means 20 are adapted to engage within a mating receiving hole or receptacle 21 which may be readily provided and drilled within the existing frame of window 3 in a suitable location in side channel 19. It will be apparent that it is but the matter of a few minutes when initially fitting an impact protector 1 to a given window 3 to install the impact protector, mark the location at which the provided latches 20 engage channel section 19, and drill a receiving hole 21 thus adapting the window to continued and easy use of the impact protector.

The latches 20 being engaged within holes 21 will retain the protector 1 in contacting relationship with window 3 against the forces of the storm. The close relationship of impact protector 1 with window 3, given the structure hereinabove disclosed, prevents any significant back forces being applied that would tend to blow out or remove the sheet from the window.

Impact protector 1 is not designed to or intended to protect window 3 against a sufficient over pressure which would drive window 3 from the house; such over pressures would be so great as to destroy the entire structure, and individual window protection is of no moment under such conditions. Rather the impact protector 1 provides protection against driven debris which would otherwise break the panes within window 3 admitting water and storm winds. It is thus sufficient for that purpose that sheet 2 have sufficient resistance to impact to avoid fracturing, and it is found that such protection may be provided by constructing sheet 3 out of material that may be as simple as three-eighths inch standard exterior plywood.

It can be seen from the description that the particular design of this particular impact protector is such that it may readily fit and adapted to a specific window and may be quickly and readily installed by a single individual from a safe location within the building in a short period of time. Thus the invention permits an individual to rapidly cover all of the provided metal frame windows within a structure with debris protection, without requiring that individual to clamber about the exterior of the house and without requiring fitting, hammering, nailing and the like. The invention thus provides a particularly convenient, safe and effective protection, easily applied by a wide range of people to render their window areas more storm resistant.

It can thus be seen that while a fairly specific design example is given above, the invention encompasses that somewhat wider range of equivalents as are encompassed by the claims.

I claim:

1. An internally installable window protector for providing storm debris impact protection to the exterior of a window having a metal frame of the type having an upper and lower screen retaining channel, comprising:

a. a rectangular sheet, having a top and bottom edge structured to a width substantially equal to said screen retaining channels, and a height substantially equal to a distance between said screen retaining channels;

b. a first handle installed adjacent a bottom edge of the said sheet and substantially centered therealong;

c. a second handle installed intermediate said first handle and a midpoint of said sheet, centered along a vertical midline thereof;

d. a first and a second latching means mounted on first and second side edges of said sheet, said means having a first, retracted position and a second extended position, said second position latchingly engaging said window frame; and e. said top edge being tapered so as to present an engaging edge to interlock with said upper screen retaining channel.

* * * * *